US005547914A

United States Patent [19]

De Meutter et al.

[11] Patent Number: 5,547,914

[45] Date of Patent: Aug. 20, 1996

[54] DIRECT THERMAL IMAGING MATERIAL

[75] Inventors: Stefaan De Meutter, Antwerpen; Eugeen Van Goethem, Bornem; Ronald Schuerwegen, Schelle; Bartholmeus Horsten, Rumst, all of Belgium

[73] Assignee: Agfa-Gevaert, N.V., Mortsel, Belgium

[21] Appl. No.: 538,860

[22] Filed: Oct. 4, 1995

[30] Foreign Application Priority Data

Oct. 14, 1994 [EP] European Pat. Off. ..... 94202980

[51] Int. Cl.[6] ..... B41M 5/32

[52] U.S. Cl. ..... 503/210; 430/567; 430/608; 430/619; 503/202; 503/214; 503/226

[58] Field of Search ..... 430/567, 608, 430/619; 503/202, 210, 214, 226

[56] References Cited

U.S. PATENT DOCUMENTS

| | | | |
|---|---|---|---|
| 3,107,174 | 10/1963 | Wartman | 117/36.2 |
| 5,189,007 | 2/1993 | Aihara et al. | 503/207 |

FOREIGN PATENT DOCUMENTS

| | | | |
|---|---|---|---|
| 0098059 | 1/1984 | European Pat. Off. | 503/226 |
| 0521423 | 1/1993 | European Pat. Off. | 503/226 |
| 2670435 | 6/1992 | France | 503/226 |
| 9411198 | 5/1994 | WIPO | 503/210 |

OTHER PUBLICATIONS

Database WPI; Derwent Publications Ltd., (London); AN 89-343802 and JP 01 255 588 (Kanzaki Paper Mfg. KK), Oct. 12, 1989 (Abstract).

*Primary Examiner*—Bruce H. Hess

*Attorney, Agent, or Firm*—Brumbaugh, Graves, Donohue & Raymond

[57] ABSTRACT

The present invention provides a recording material comprising on a support (i) a heat sensitive layer comprising a substantially light insensitive organic silver salt, (ii) a protective layer containing calcined China clay dispersed in a binder and (iii) a reducing agent being present in the heat sensitive layer and/or another layer on the same side of the support carrying the heat sensitive layer. The present invention further provides a method for making images therewith. The obtained images may be used in medical diagnostics.

12 Claims, No Drawings

DIRECT THERMAL IMAGING MATERIAL

DESCRIPTION

1. Field of the Invention

The present invention relates to a recording material suited for use in direct thermal imaging. More in particular the present invention relates to a recording material based on a heat induced reaction between a substantially light insensitive organic silver salt and a reducing agent.

2. Background of the Invention

In thermography two approaches are known :

1. Direct thermal formation of a visible image pattern by imagewise heating of a recording material containing matter that by chemical or physical process changes colour or optical density.

2. Thermal dye transfer printing wherein a visible image pattern is formed by transfer of a coloured species from an imagewise heated donor element onto a receptor element.

Thermal dye transfer printing is a recording method wherein a dye-donor element is used that is provided with a dye layer wherefrom dyed portions of incorporated dye is transferred onto a contacting receiver element by the application of heat in a pattern normally controlled by electronic information signals.

The optical density of transparencies produced by the thermal transfer procedure is rather low and in most of the commercial systems—in spite of the use of donor elements specially designed for printing transparencies—only reaches 1 to 1.2 (as measured by a Macbeth Quantalog Densitometer Type TD 102). However, for many application fields a considerably higher transmission density is asked for. For instance in the medical diagnostical field a maximal transmission density of at least 2.5 is desired.

High optical densities can be obtained using a recording material comprising on a support a heat sensitive layer comprising a substantially light insensitive organic silver salt and a reducing agent. Such material can be image-wise heated using a thermal head causing a reaction between the reducing agent and the substantially light insensitive organic silver salt leading to the formation of metallic silver. To obtain a good thermosensitivity heating is carried by contacting the thermal head with the heat sensitive layer. The density level may be controlled by varying the amount of heat applied to the recording material. This is generally accomplished by controlling the number of heat pulses generated by the thermal head. An image having a grey scale is thus obtained.

Because of its high density the image is in principal suitable for use as a medical diagnostic image. However the following problems have been encounterred. Uneveness of density occurs with the number of images that have been printed and damaging of the heat sensitive layer occurs. These problems can be overcome by making use of a protective layer. Although this brings a substantial improvement so that the image may be suitable for some applications, the images show scratches that are prohibitive for the use of the image in medical diagnostics.

SUMMARY OF THE INVENTION

It is an object of the present invention to improve the quality of images obtained by direct thermal imaging of a recording material comprising on a support (i) a heat sensitive layer comprising a substantially light insensitive organic silver salt and (ii) a reducing agent being present in the heat sensitive layer or another layer on the same side of the support carrying the heat sensitive layer.

Further objects of the present invention will become clear from the description hereinafter.

According to the present invention there is provided a recording material comprising on a support (i) a heat sensitive layer comprising a substantially light insensitive organic silver salt, (ii) a protective layer containing calcined China clay dispersed in a binder and (iii) a reducing agent being present in the heat sensitive layer and/or another layer on the same side of the support carrying the heat sensitive layer.

According to the present invention there is provided a method for making an image comprising image-wise heating by means of a thermal head a recording material as defined above said thermal head contacting the protective layer of said recording material.

DETAILED DESCRIPTION

Thanks to the use of calcined China clay in the protective layer the occurrences of scratches can be reduced and in some cases scratches are completely avoided. Calcined China clay is obtained by heat treatment of hydrous or natural China clay at 500° C. or more. The hydroxyl groups that form part of the crystal structure of the natural China clay are lost during this heat treatment.

The calcined China clays are preferably incorporated in the protective layer in such a way, i.e. by selecting the appropriate size with respect to the thickness of the protective layer and amounts of calcined China clay that at least part of them protrudes from the protective layer.

The calcined China clay particles are preferably used in an amount of 0.1 to 50% by weight more preferably in an amount of 0.25 to 30% by weight of the binder.

Examples of calcined China clay (CCC) particles that can be used advantageously in accordance with the present invention are i.a.:

Calcined China clays commercially available from ENGELHARD MINERALS & COLORS GROUP, ENGELHARD CORPORATION:

| tradename | average particle size | + 44μ (% max) |
|---|---|---|
| SATINTONE 5 | 0.8μ | 0.015 |
| SATINTONE 5HB | 0.8 | 0.015 |
| SATINTONE SPECIAL | 1.2 | 0.01 |
| SATINTONE OP | 1.3 | 0.02 |
| SATINTONE W | 1.4 | 0.02 |
| SATINTONE PLUS | 2.0 | 0.05 |

Calcined China clays are also commercially available from ECC:

| tradename | −2μ (%) | −3μ (%) | +10μ (% max) |
|---|---|---|---|
| INFILM 813 | — | 98 ± 1 | 0.10 |
| INFILM 1735 | 54 ± 5 | — | 0.50 |
| INFILM 2654 | 25–30 | — | 0.50 |
| POLESTAR 400A | 91 ± 2 | — | 0.50 |
| POLESTAR 200R | 52.5 ± 5 | — | 12 |

Calcined China clay slurties are also commercially available from ECC, e.g. a 50% POLESTAR™ 400A-slurry with DISPEX™ N40 (commercially available from Allied Colloids) as polymeric dispersing agent.

Surface modified calcined China clays can also be used in connection with the present invention and are commercially available from ENGELHARD MINERALS & COLORS GROUP, ENGELHARD CORPORATION:

| tradename | surface treatment | average particle size (before treatment) | +44μ (% max) (before treatment) |
|---|---|---|---|
| TRANSLINK 37 | vinyl functional | 1.4 | 0.03 |
| TRANSLINK 77 | vinyl functional | 0.8 | 0.02 |
| TRANSLINK 445 | amino silane | 1.4 | 0.02 |
| TRANSLINK 555 | amino silane | 0.8 | 0.02 |
| TRANSLINK HF-900 | amino silane | 1.8 | 0.04 |

The surface modification provides excellent dispersion and chemical reactivity in many polymer systems.

The calcined China clay particles used in accordance with the present invention may be used in combination with matting agents. However, preferably the amount of matting agent will be less than the amount of calcined China clay particles more preferable the weight ratio of calcined china clay particles to matting agent is at least 2. Suitable matting agents for use in connection with the present invention are particles that protrude from the protective layer and they can be organic or inorganic. They are sufficiently large to avoid the scratches but are on the other hand limited in their size because of pinholes that may occur at places where a matting agent is present due to a reduced thermoconductivity at these places. Preferably the matting agent will have an average diameter between 0.7 and 1.5 times the thickness of the protective layer. It is also preferred that the matting agents when used in connection with the present invention are capable of withstanding the temperatures involved in the heating process according to the present invention. Generally they should be able to withstand a temperature of upto 400° C. without showing substantial deformations.

Examples of matting agents that can be used are silicone resin particles, silicates, alumina, polymethylmethacrylate particles, polyacrylate particles etc.

Preferred silicate particles having a mildly abrasive character are i.a. clay, China clay, talc (magnesium silicate), mica, silica, calcium silicate, aluminium silicate, and aluminium magnesium silicate. China clay pigments are very useful because of their hardness and improvement of the clearness of the film due to the narrow size distribution of certain types.

Calcined china clays offer distinct advantages compared with natural clays. Calcined china clays are more spherical and irregular in shape. These particle shapes give a lower pigment volume concentration. The calcined china clay particles give a considerable higher scrub resistance than natural china clay.

The binder for use in the protective layer in connection with the present invention is preferably polymeric and can be selected from amongst hydrophobic and hydrophilic binders. The latter are preferred in connection with the present invention since it has been found that less dirt forms on the thermal head during printing. The protective layer may also be hardened. Hardening may be carried out by means of UV or electron beam curing or the hardening may be effected using a chemical reaction between a hardening agent and the binder. Suitable hardening agents that can be used to harden a binder having active hydrogens are e.g. polyisocyanates, aldehydes and hydrolysed tetraalkyl orthosilicates.

Examples of binders that can be used in connection with the present invention are e.g. copolymers of styrene and acrylonitrile, copolymers of styrene, acrylonitrile and butadiene, nitrocellulose, copolymers of vinylacetate and vinylchloride which may be partially hydrolysed, polyesters and polycarbonates in particular those derived from a compound according to the following formula:

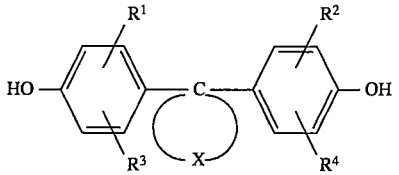

wherein $R^1$, $R^2$, $R^3$, and $R^4$ each independently represents hydrogen, halogen, a $C_1$–$C_8$ alkyl group, a substituted $C_1$–$C_8$ alkyl group, a $C_5$–$C_6$ cycloalkyl group, a substituted $C_5$–$C_6$ cycloalkyl group, a $C_6$–$C_{10}$ aryl group, a substituted $C_6$–$C_{10}$ aryl group, a $C_7$–$C_{12}$ aralkyl group, or a substituted $C_7$–$C_{12}$ aralkyl group; and X represents the atoms necessary to complete a 5- to 8-membered alicyclic ring, optionally substituted with a $C_1$–$C_6$ alkyl group, a 5- or 6-membered cycloalkyl group or a fused-on 5- or 6-membered cycloalkyl group.

Suitable hydrophilic binders for use in connection with the present invention include polyvinyl alcohol, polyvinyl acetate preferably hydrolysed in amount of 20% by weight or more, polyvinylpyrrolidone, gelatine etc. The hydrophilic binder for use in the protective layer preferably has a weight average molecular weight of at least 20000 g/mol more preferably at least 30000 g/mol. According to a most preferred embodiment in connection with the present invention there is used a protective layer that contains a hydrolysed polyvinyl acetate hardened with a tetraalkyl orthosilicate.

In accordance with the present invention it is also preferred to add a lubricant to the protective layer or applying a lubricant on top of the protective layer. By using a lubricant transportation problems of the recording material under the thermal head can be avoided as well as image deformations. The lubricant is preferably used in an amount of 0.1% by weight to 10% by weight of the binder in the protective layer. Suitable lubricants for use in connection with the present invention are e.g. silicone oils, polysiloxanepolyether copolymers, synthetic oils, saturated hydrocarbons, glycols, fatty acids and salts or esters thereof such as e.g. stearic acid, the zinc salt of stearic acid, methyl ester of stearic acid etc.

According to a particular embodiment in connection with the present invention the lubricant may be hardened together with the binder of the protective layer. For example a binder having active hydrogens and a polysiloxane having active hydrogens may be hardened by means of e.g. polyisocyanate or a tetraalkyl orthosilicate yielding a hardened protective layer containing a lubricant.

The thickness of the protective layer in connection with the present invention is preferably between 1 μm and 10 μm, more preferably between 1.5 μm and 7 μm.

Substantially light-insensitive organic silver salts particularly suited for use according to the present invention are silver salts of aliphatic carboxylic acids known as fatty acids, wherein the aliphatic carbon chain has preferably at least 12 C-atoms, e.g. silver laurate, silver palmirate, silver stearate, silver hydroxystearate, silver oleate and silver behenate, and likewise silver dodecyl sulphonate described in U.S. Pat. No. 4,504,575 and silver di-(2-ethylhexyl)-sulfosuccinate described in published European patent application 227 141. Useful modified aliphatic carboxylic acids with thioether group are described e.g. in GB-P 1,111,492 and other organic silver salts are described in GB-P 1,439,478, e.g. silver benzoate and silver phthalazinone, which may be used likewise to produce a thermally developable silver image. Further are mentioned silver imidazolates and the substantially light-insensitive inorganic or organic silver salt complexes described in U.S. Pat. No. 4,260,677.

As binding agent for the heat sensitive layer preferably thermoplastic water insoluble resins are used wherein the ingredients can be dispersed homogeneously or form therewith a solid-state solution. For that purpose all kinds of natural, modified natural or synthetic resins may be used, e.g. cellulose derivatives such as ethylcellulose, cellulose esters, carboxymethylcellulose, starch ethers, polymers derived from α,β-ethylenically unsaturated compounds such as polyvinyl chloride, after chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals, e.g. polyvinyl butyral, copolymers of acrylonitrile and acrylamide, polyacrylic acid esters, polymethacrylic acid esters and polyethylene or mixtures thereof. A particularly suitable ecologically interesting (halogen-free) binder is polyvinyl butyral. A polyvinyl butyral containing some vinyl alcohol units is marketed under the trade name BUTVAR B79 of Monsanto USA.

The binder to organic silver salt weight ratio is preferably in the range of 0.2 to 6, and the thickness of the image forming layer is preferably in the range of 5 to 16 μm.

The above mentioned polymers or mixtures thereof forming the binder may be used in conjunction with waxes or "heat solvents" also called "thermal solvents" or "thermo-solvents" improving the penetration of the reducing agent(s) and thereby the reaction speed of the redox-reaction at elevated temperature.

By the term "heat solvent" in this invention is meant a non-hydrolyzable organic material which is in solid state at temperatures below 50° C. but becomes on heating above that temperature a plasticizer for the binder of the layer wherein they are incorporated and possibly act then also as a solvent for at least one of the redox-reactants, e.g. the reducing agent for the organic silver salt. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1,1-dioxide, methyl anisate and 1,10-decanediol being described as heat solvents in Research Disclosure, December 1976, (item 15027) pages 26–28. Still other examples of heat solvents have been described in U.S. Pat. Nos. 3,438,776, and 4,740,446, and in published EP-A 0 119 615 and 0 122 512 and DE-A 3 339 810.

Suitable organic reducing agents for the reduction of substantially light-insensitive organic silver salts are organic compounds containing at least one active hydrogen atom linked to O, N or C, such as is the case in aromatic di- and tri-hydroxy compounds. e.g. hydroquinone and substituted hydroquinones, catechol, pyrogallol, gallic acid and gallares: aminophenols, METOL (tradename), p-phenylenediamines, alkoxynaphthols, e.g. 4-methoxy-1-naphthol described in U.S. Pat. No. 3,094,417, pyrazolidin-3-one type reducing agents, e.g. PHENIDONE (tradename), pyrazolin-5-ones, indanedione-1,3 derivatives, hydroxytetrone acids, hydroxytetronimides, reductones, and ascorbic acid. Representatives for thermally activated reduction of organic silver salts are described e.g. in U.S. Pat. Nos. 3,074,809, 3,080,254, 3,094,417, 3,887,378 and 4,082,901.

Particularly suited organic reducing agents for use in thermally activated reduction of the substantially light insensitive silver salts are organic compounds containing in their structure two free hydroxy groups (—OH) in ortho-position on a benzene nucleus as is the case in catechol and polyhydroxy spiro-bis-indane compounds corresponding to the following general formula (I) which are preferred for use in the recording material according to the present invention:

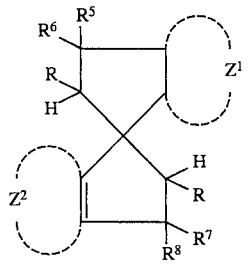

wherein:

R represents hydrogen or alkyl, e.g. methyl or ethyl, each of $R^5$ and $R^6$ (same or different) represents, an alkyl group, preferably methyl group or a cycloalkyl group, e.g. cyclohexyl group, each of $R^7$ and $R^8$ (same or different) represents, an alkyl group, preferably methyl group or a cycloalkyl group, e.g. cyclohexyl group, and each of $Z^1$ and $Z^2$ (same or different) represents the atoms necessary to close an aromatic ring or ring system, e.g. benzene ring, substituted with at least two hydroxyl groups in ortho- or para-position and optionally further substituted with at least one hydrocarbon group, e.g an alkyl or aryl group.

Particularly useful are the polyhydroxy-spiro-bis-indane compounds described in U.S. Pat. No. 3,440,049 as photographic tanning agent, more especially 3,3,3',3'-tetramethyl-5,6,5',6'-tetrahydroxy-1,1'-spiro-bis-indane (called indane I) and 3,3,3',3'-tetramethyl- 4,6,7,4',6',7'-hexahydroxy-1,1'-spiro-bis-indane (called indane II). Indane is also known under the name hydrindene.

Preferably the reducing agent is added to the heat sensitive layer but all or part of the reducing agent may be added to one or more other layers on the same side of the support as the heat sensitive layer. For example, all or part of the reducing agent may be added to the protective surface layer.

The recording material may contain auxiliary reducing agents having poor reducing power in addition to the main reducing agent described above preferably in the heat sensitive layer containing the organic silver salt. For that purpose preferably sterically hindered phenols are used.

Sterically hindered phenols as described e.g. in U.S. Pat. No. 4,001,026 are examples of such auxiliary reducing agents that can be used in admixture with said organic silver salts without premature reduction reaction and fog-formation at room temperature.

For obtaining a neutral black image tone with silver formed in the higher optical density parts and neutral grey in the lower densities the reducible silver salt(s) and reducing agents are advantageously used in conjunction with a so-called toning agent known from thermography or photothermography.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Particularly useful toning agents are likewise the heterocyclic toner compounds of the benzoxazine dione or naphthoxazine dione type.

According to the present invention an image can be obtained with the above described recording material by image-wise heating the recording material by moving the recording material under a thermal head, said thermal head contacting the protective layer. The recording material may be heated with a temperature of upto 400° C. by varying the number of heat pulses given by the thermal head. By varying the number of heat pulses the density of the corresponding image pixel is varied correspondingly.

The present invention will now be illustrated by the following examples without however the intention to limit the invention thereto. All parts are by weight unless otherwise specified.

EXAMPLE 1

A subbed polyethylene terephthalate support having a thickness of 100 μ was coated with an extrusion coater so as to obtain thereon after drying the following heat sensitive layer including:

| | |
|---|---|
| silver behenate | 4.42 g/m$^2$ |
| polyvinylbutyral | 4.42 |
| reducing agent S as defined hereinafter | 0.84 |
| 3,4-dihydro-2,4-dioxo-1,3,2H-benzoxazine | 0.34 |
| silicone oil | 0.02 |

Reducing agent S is 1,1'-spirobi(1H-indene)-5,5',6,6'-tetrol-2,2',3,3'-tetrahydro-3,3,3',3'-tetramethyl.

To the heat-sensitive layer was doctor blade-coated a protective layer having the following composition:

| | |
|---|---|
| polycarbonate (see below) | 4.02 g/m$^2$ |
| calcined China clay SATINTONE™ 5 | 1.5 |
| SOLSPERSE™ 24000* | 0.15 |
| TEGO-GLIDE™ 410** | 0.3 |
| silicone oil | 0.03 |

*SOLSPERSE™ 24000 is a dispersing agent and commercially available from ZENECA COLOURS.
**TEGO-GLIDE™ 410 is a lubricant of the polysiloxane/polyether type and commercially availbale from TEGO-CHEMIE.

The polycarbonate used was a polycarbonate derived from 1,1-bis-( 4-hydroxyphenyl)-3,3,5-trimethylcyclohexane having a molecular weight such that a relative viscosity of 1.295 (measured in a 0.5% by weight solution in dichloromethane) is obtained.

The recording material prepared as described above was imagewise heated with a thermal head in a thermal printer so as to obtain a density of 3.2. The obtained minimum density was 0.05. The obtained image was then visually inspected for scratches. No scratches could be determined. Furthermore, it was found that no contamination of the thermal head occurred.

EXAMPLE 2

A recording material was prepared as described in example 1 with the exception however that the calcined China clay was replaced by a hydrous, natural China clay. The thus obtained recording material was printed and evaluated as described in example 1. The image showed some scratches and contamination of the thermal head was found.

We claim:

1. A recording material comprising on a support (i) a heat sensitive layer comprising a substantially light insensitive organic silver salt, (ii) a protective layer containing a calcined China clay or surface modified calcined China clay dispersed in a binder and (iii) a reducing agent being present in the heat sensitive layer and/or another layer on the same side of the support carrying the heat sensitive layer.

2. A recording material according to claim 1 wherein said binder is a polycarbonate.

3. A recording material according to claim 1 wherein said protective layer further comprises a lubricant or wherein a lubricant is present on top of said protective layer.

4. A recording material according to claim 1 wherein said binder is hydrophilic.

5. A recording material according to claim 4 wherein said binder is polyvinyl alcohol or a polyvinyl acetate.

6. A recording material according to claim 4 wherein said protective layer is hardened.

7. A method for making an image comprising image-wise heating a recording material comprising on a support (i) a heat sensitive layer comprising a substantially light insensitive organic silver salt, (ii) a protective layer containing a calcined China clay or surface modified calcined China clay dispersed in a binder and (iii) a reducing agent being present in the heat sensitive layer and/or another layer on the same side of the support carrying the heat sensitive layerby means of a thermal head contacting the protective layer of the recording material.

8. A method according to claim 7 wherein said binder is a polycarbonate.

9. A method according to claim 7 wherein said protective layer further comprises a lubricant or wherein a lubricant is present on top of said protective layer.

10. A method according to claim 7 wherein said binder is hydrophilic.

11. A method according to claim 7 wherein said binder is polyvinyl alcohol or a polyvinyl acetate.

12. A method according to claim 7 wherein said protective layer is hardened.

* * * * *